United States Patent [19]

Parl et al.

[11] Patent Number: 4,737,928

[45] Date of Patent: Apr. 12, 1988

[54] HIGH ACCURACY RANDOM CHANNEL REPRODUCING SIMULATOR

[75] Inventors: Steen A. Parl, Arlington; John N. Pierce, Lexington, both of Mass.

[73] Assignee: Signatron, Inc., Lexington, Mass.

[21] Appl. No.: 753,405

[22] Filed: Jul. 10, 1985

[51] Int. Cl.[4] ..... G06G 7/62; G06G 7/48

[52] U.S. Cl. ..... 364/802; 364/801

[58] Field of Search ..... 364/802, 801, 819

[56] References Cited

U.S. PATENT DOCUMENTS 4,105,958 8/1978 Pierce et al. ..... 364/802

FOREIGN PATENT DOCUMENTS 955116 8/1982 U.S.S.R. ..... 364/802
1012283 4/1983 U.S.S.R. ..... 364/802
1103256 7/1984 U.S.S.R. ..... 364/802

*Primary Examiner*—Jerry Smith

*Assistant Examiner*—Charles B. Meyer

*Attorney, Agent, or Firm*—Robert F. O'Connell

[57] ABSTRACT

A channel propagation simulator simulates a multi-diversity branch signal channel, which simulator uses in a preferred embodiment appropriate filter means, such as a plurality of tapped delay lines 11, 14, each capable of representing the impulse response of a diversity branch by means of correlated tap multipliers 12, 12A, 15, 15A . . . 15N, i.e., multipliers using correlated weighting signals 12', 12'A, 15', 15'A . . . 15'N as supplied from a matrix weighting correlator 19. The correlated weighted signals are combined for each diversity branch by suitable summation circuits 13, 16 to provide the diversity branch simulated outputs. By using correlated weighting signals, the simulator can more accurately reproduces the statistical behavior of a given communications link and verify that a given modem will satisfy the communication link specifications.

14 Claims, 3 Drawing Sheets

HIGH ACCURACY RANDOM CHANNEL REPRODUCING SIMULATOR

INTRODUCTION

Figure 1:
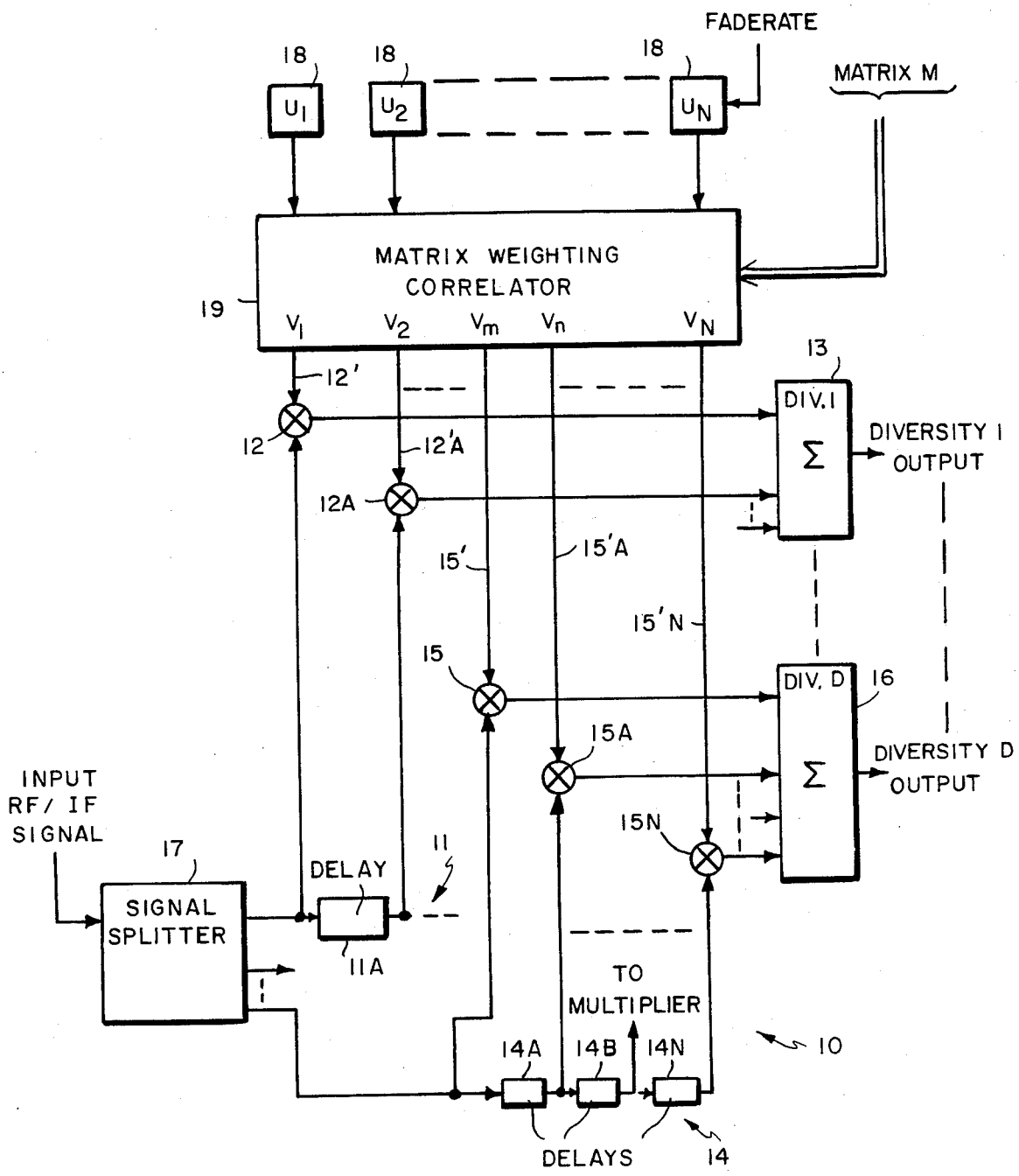

This invention relates generally to channel propagation simulators and, more particularly, to channel simulators which are intended to accurately reproduce representative effects of signal propagation media which exhibit fading and/or dispersion, such as found in media used in communications, navigation, radar, and sonar applications.

BACKGROUND OF THE INVENTION

The behavior of such a channel has been modeled mathematically by a delay line with a continuum of taps each of which acts as if the signal underwent uncorrelated scattering and multiplicative fading, the outputs of which taps are then all appropriately combined by summation. If the fading is wide sense stationary, such channels are sometimes referred to in the art as WSSUS channels. More generally, such channels can also be mathematically modeled by a bank of filters. Under certain propagation conditions which generate very extensive dispersion, a conventional method of providing equipment which simulates the behavior of such channels normally requires a very large number of uncorrelated taps so that the cost of producing such a channel simulator becomes relatively costly and in some cases prohibitively expensive. Moreover, under other circumstances the accuracy achieved by the use of such conventional channel simulation techniques is simply not adequate.

Channel simulators of such type have been described, for example, in the following publications:

1. P. A. Bello and L. Ehrman, "Troposcatter Model Performance Prediction with a Complex Gaussian Troposcatter Channel Simulator", Conf. Rec., IEEE Int. Conf. Commun., 1969, pp. 48–11 to 48–16.

2. L. Ehrman, "Tropo diversity simulator development", SIGNATRON, INC., USAF Rome Air Development Center, Final Report Contract F30602-73-C-0216, July 1974.

3. J. J. Bussgang, E. H. Getchell, B. Goldberg and P. F. Mahoney, "Stored Channel Simulation of Tactical VHF Radio Links", IEEEE Trans. Communications, Vol. COM-24, pp. 154–169, February 1976.

Such fading channel simulators have been used to test high frequency and troposcatter systems and utilize tapped delay lines, one for each diversity branch, each of which uses a plurality of uncorrelated tap weights. Simulators of the type described above can demonstrate radio frequency performance normally only for special types of random channels where the signal scattering vs. delay characteristic occurs at discrete times. Such simulation may be adequate for comparing different radio frequency channel operations and for verifying such operations. However, it is normally not adequate for determining whether a radio frequency communication system, for example, will operate within selected specifications on a given communications media link. Moreover, in such simulators the actual power impulse response function of the media link cannot be prescribed by the user of the simulator. Instead existing simulators require that the user specify the power level of each uncorrelated tap weight and further require the user to determine what those power levels should be from the given power impulse response.

All such currently known high frequency simulators operate with uncorrelated tap weights, simulators for troposcatter systems normally being implemented with analog circuits, while those for other high frequency simulators normally being implemented digitally by using an array processor, for example.

It is desirable to provide channel simulators, however, which, in a more cost effective manner than previously proposed simulators, will provide accurate modeling by using, for example, fewer than the conventional number of taps on the delay lines involved. Such a simulator further should be designed to act on the signal transmitted by an actual radio frequency system in order to simulate signals that would be received in one or more diversity receivers of such a system. Such a simulator should be usable to test the performance of radio frequency systems and to compare such performance with theoretical performance characteristics using simulator settings for either the parameters of a hypothetical fading channel or for the measured characteristics of an actual channel.

BRIEF SUMMARY OF THE INVENTION

In accordance with the invention a channel propagation simulator, for simulating a signal channel having one or more diversity branches, utilizes a signal weighting means which responds to an input signal and to a plurality of weighting signals which are selectively correlated with each other so as to provide a plurality of weighted output signals associated with each of the diversity branches, the weighted output signals associated with each diversity branch being combined to provide one or more combined output signals which represent the simulated outputs from each of the diversity branches. In a preferred embodiment, the signal weighted means utilizes a plurality of tapped delay lines each of which is capable of representing the impulse response of a diversity branch of a random channel by means of correlated tap multipliers, or tap weights. Such correlated tap weights can be obtained by using uncorrelated noise sources with variable bandwidths determined by the desired fade rate setting for the channel being simulated and implementing a matrix multiplication technique for combining the uncorrelated noise sources in a way that produces correlated noise sources using a specified covariance matrix.

By using such correlated tap weights the simulator of the invention can accurately reproduce the statistical behavior of a given communications link and verify that a given modem, for example, will satisfy the communications link specifications. Moreover, such operation can be achieved at reasonable cost since many fewer taps are required in accordance therewith than would be utilized in a simulator having uncorrelated tap weights.

DESCRIPTION OF THE INVENTION

Figure 2:
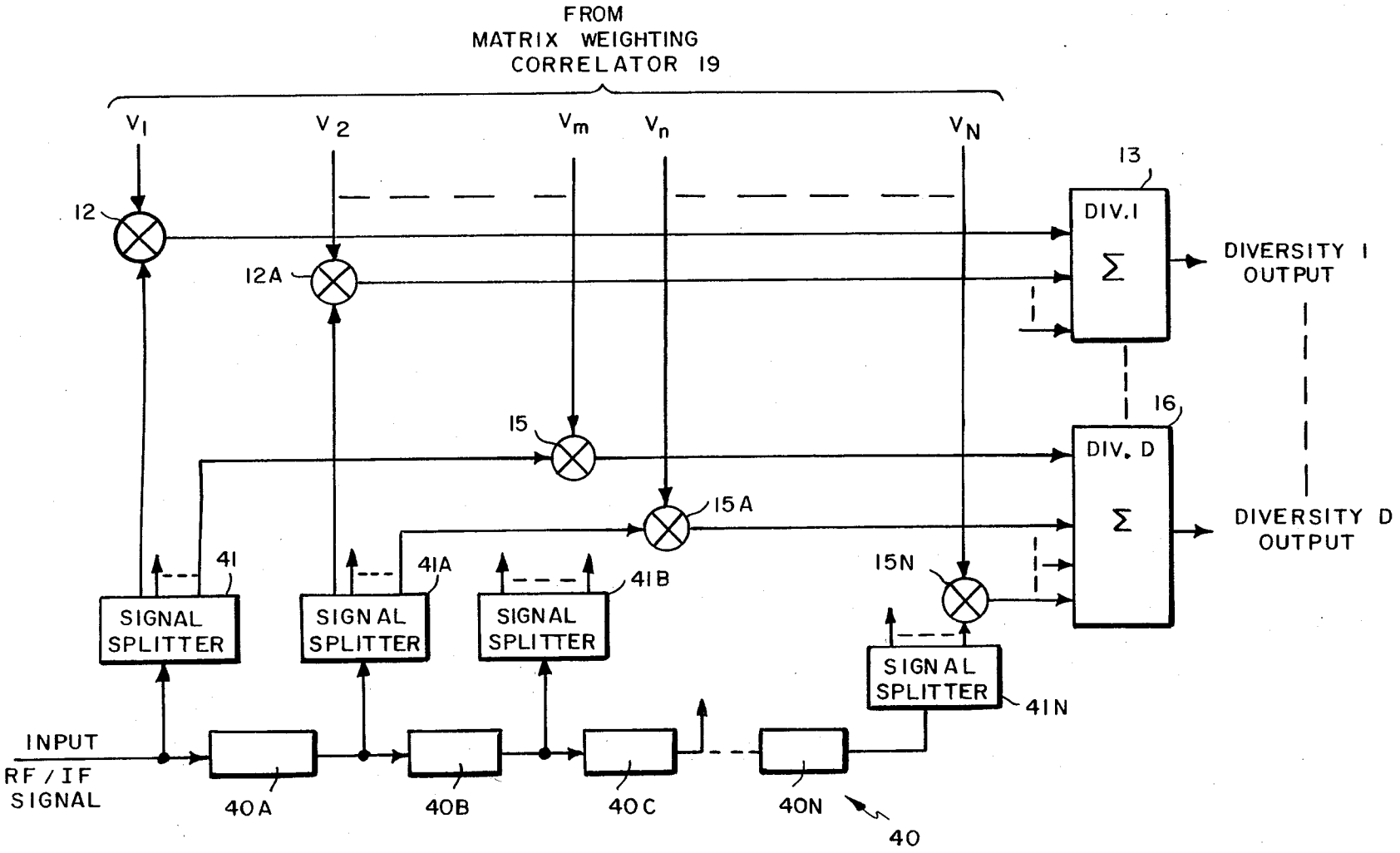
Figure 3:
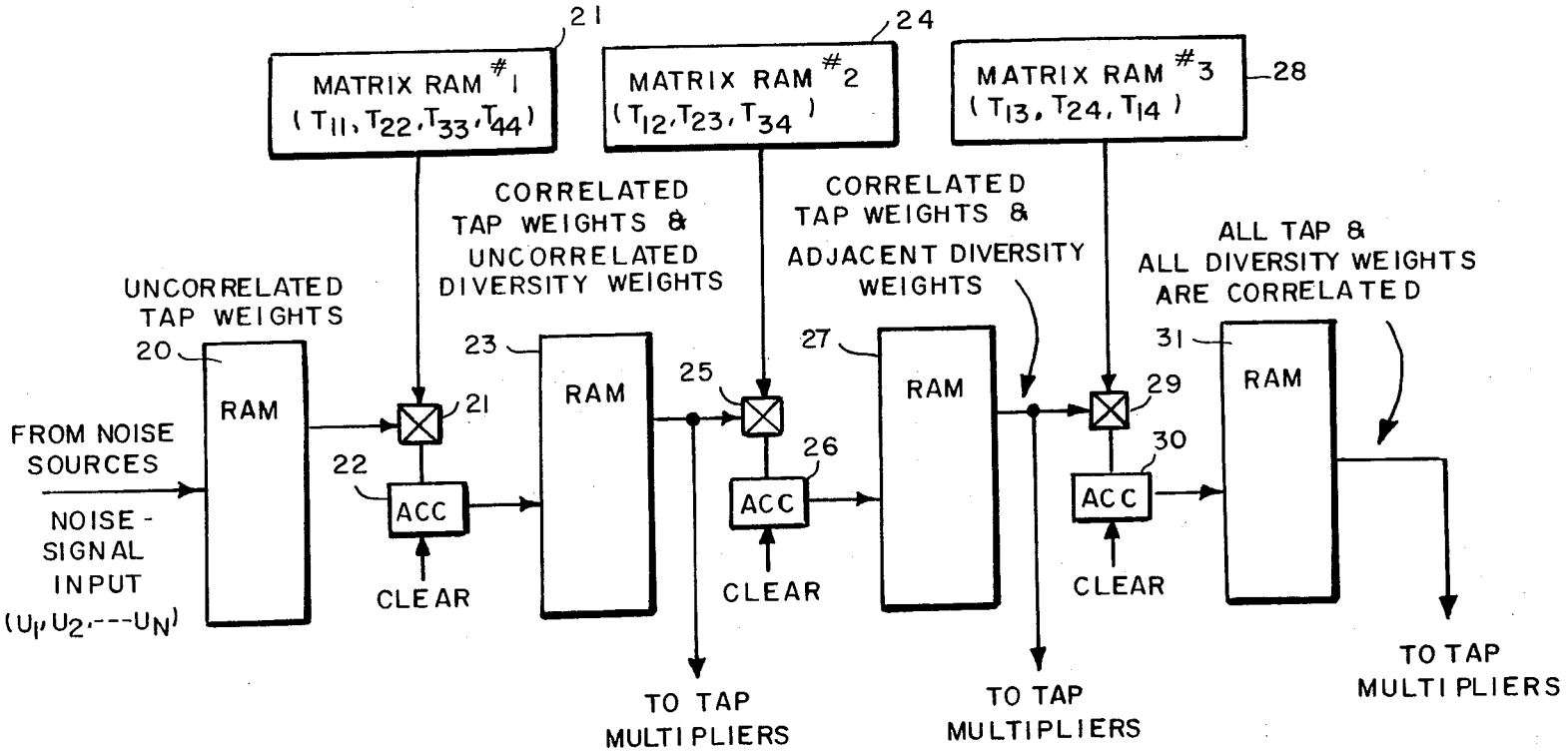

The invention can be described in more detail with the help of the accompanying drawings wherein FIG. 1 shows a block diagram of an exemplary embodiment of a simulator in accordance with the invention;

FIG. 2 shows a block diagram of an alternative embodiment of the simulator of FIG. 1; and FIG. 3 shows a block diagram of an exemplary embodiment of a noise signal matrix correlator for use in an embodiment of the invention having four diversities and identical Doppler spectra on all taps.

As can be seen in FIG. 1, a random communications channel can be simulated in the form of a plurality of diversity branches thereof which are identifiable here as diversity branches 1 through D. In FIG. 1 only diversity branch 1 and diversity branch D are depicted, it being understood that any number of additional diversity branches may be included as part of the overall simulated system.

The diversity branches can be simulated in accordance with the principles of the invention using appropriate filter means. Filter means, as used herein is intended to means any linear circuit or device which responds to an input signal and produces one or more output signals, the values of which at a given time depend only on the present or past values of the input signal. A time delay means such as a delay line circuit, represents an example of a filter means, as used herein.

In a preferred embodiment of the invention, as specifically designated in FIG. 1, an exemplary diversity branch 1, for example, includes a delay line 11 to which is supplied an input signal from a signal splitter 17. The input signal may be either in the radio frequency (RF) portion of the spectrum or in the intermediate frequency (IF) portion of the spectrum. In the embodiment depicted, the delay line provides one or more time delays, one of which is shown as delay 11A, so that such delay line has a plurality of taps, two of which are shown as providing an undelayed input signal to a multiplier 12 and a delayed signal to a multiplier 12A. Thus, it is understood that any number of additional taps may be included in each diversity branch as part of the overall simulated system.

In exemplary diversity branch D the input signal is also supplied from signal splitter 17 to a delay line 14 which comprises a plurality of time delays 14A, 14B . . . and 14N so that a plurality of time delayed signals are provided at a plurality of taps, one of which supplies an undelayed input signal to multiplier 15, another tap of which supplies the input signal delayed by time delay 14A to a multiplier 15A, another tap of which supplies the input signal to a multiplier (not shown) which has been delayed by both time delays 14A and 14B, and so forth, until the final tap supplies a signal which has been delayed by delays 14A, 14B . . . 14N to a multiplier 15N.

Each of the multipliers is supplied with a weighting signal obtained from a matrix weighting correlator 19, as discussed in more detail below. Thus for the multipliers illustrated, multiplier 12 receives a tap weight signal 12', multiplier 12A receives a tap weight signal 12'A, multiplier 15 receives a tap weight signal 15', multiplier 15A receives a tap weight signal 15'A and multiplier 15N receives a tap weight signal 15'N. The weighted signals at the output of each of the multipliers of each of the diversity branches are supplied to a signal combining (e.g. summation) circuit 13 . . . 16, respectively, for diversity branches 1 . . . D, as shown, the combined signals in each branch providing the diversity branch output signals, DIVERSITY 1 OUTPUT through DIVERSITY D OUTPUT, as depicted.

An alternative embodiment shown in FIG. 2 utilizes a single delay line 40 providing a plurality of time delayed signals at a plurality of taps as depicted by delays 40A, 40B, 40C . . . 40N. The input RF or IF signal is supplied to delay line 40. The undelayed input signal is supplied to a signal splitter 41 for supplying an undelayed signal to multiplier 12 of diversity branch 1 and for supplying undelayed signals to other corresponding multipliers associated with the other diversity branches, e.g., to multiplier 15 of diversity branch D. A first delayed signal from delay 40A is supplied to signal splitter 41A for supplying a first delayed signal to multiplier 12A of diversity branch 1 and for supplying first delayed signals to other corresponding multipliers associated with other diversity branches, e.g., to multiplier 15A of diversity branch D. Each successive delayed signal is supplied to a corresponding signal splitter 41B, 41C . . . 41N and, thence, to appropriate multipliers in one or more of the diversity branches 1 through D.

The tap weights received from matrix weighting correlator 19 in either FIG. 1 or FIG. 2 are correlated in the sense that at least the tap weights supplied to the multipliers in each branch are correlated with each other, either completely (i.e., all the weighting signals are correlated with each other) or at least partially (i.e. selected weighting signals are correlated with each other but not with the remaining weighting signals). Moreover, in some applications it may be desirable to correlate not only the tap weights at the delay lines within each branch but also to correlate the tap weights among branches, again either partially or completely. Examples of such alternative correlations are discussed in more detail below.

In the particular embodiment depicted the matrix weighting correlator produces correlated weighting signals by matrix multiplication of a plurality of input noise sources 18 which supply noise signals $u_1, u_2 \ldots u_N$, as shown, which noise source signals are all uncorrelated with specified spectra, not necessarily identical. Multiplication by an appropriate matrix multiplier in matrix weighting correlator 19 thereupon produces a plurality of output weighting signals, identified at $v_1, v_2, \ldots v_M, v_N \ldots v_N$ for supply to the multipliers in each of the diversity branches, which weighting signals are correlated either partially or completely with each other depending on the selected matrix multiplier. Thus, the matrix multiplication may be arranged in one instance so that weighting signals supplied to the multipliers of a particular diversity branch are all correlated with each other or, alternatively, are partially correlated with each other. One such partial correlation, for example, may be such that only adjacent weighting signals in a particular diversity branch are correlated with each other. In addition thereto, the matrix utilized in the matrix weighting correlator may also be arranged to provide for correlation not only within a diversity branch but also for correlation among weighting signals of different diversity branches, either completely or partially. For complete correlation, all of the weighting signals $v_1 \ldots v_N$ may be correlated with each other. In contrast, for partial correlation in this regard, for example, the matrix can be arranged so that only weighting signals of adjacent diversity branches are correlated.

Since matrix multiplication techniques are known to those in the art, the implementation of matrix weighting correlator 19 would be within the skill of the art. For example, such operation may be performed to implement a co-variance matrix derived in accordance with a specific procedure, such as that discussed in Appendix A hereof.

In a simulator system in accordance with the invention, the tapped delay lines need not have equally spaced taps nor is it necessary to have the same number of taps in each of the diversity branches.

In devising a useful simulator in accordance with the invention shown in FIG. 1 or FIG. 2 it is found that the use of correlated tap weighting signals, rather than the completely uncorrelated weighting signals as in the prior art, achieves a specified fidelity in modeling a channel with a smaller number of tap multipliers and fewer time delays than would be required by such currently known simulators. Alternatively, for the same number of tap multipliers as would be used in a conventional uncorrelated tap weight simulator, a simulator in acordance with the invention permits greater fidelity or accuracy in simulating the channel involved. Such higher fidelity can be accomplished by selecting correlations among the taps that permit specified levels of statistical fidelity to arbitrary channel power vs. delay profiles.

The fidelity of the channel which is being modeled is further increased when the bandwidth of the radio frequency channel under test is smaller than the maximum bandwidth (the Nyquist bandwidth) required for accurate simulation. Such an increase in fidelity can be more easily established with a system in accordance with the invention than with simulators which use uncorrelated tap weights.

The correlated signals are, in effect, slowly varying complex numbers which, in the preferred embodiment, are in the form of correlated Gaussian variables and can be generated in a number of different ways within the skill of the art.

Moreover, the tapped delay line implementations utilized in a system in accordance with the invention may have several alternative forms. For example, one form, as mentioned above, may utilize a complex representation, i.e., measuring separate weights for In-phase (I) and Quadrature (Q) components of the signal. Such components can be separated by normal quadrature hybrid devices. In another implementation, for example, tap pairs with quarter wave length spacing between the taps in each pair can be used. The spacing between tap pairs is the same as the spacing between complex In-phase and Quadrature taps in a complex delay line implementation. In a still further alternative implementation the wave forms may be digitized and the tapped delay line may be implemented with appropriately designed digital circuitry. A still further implementation may involve the implementation of the delay lines by utilizing software in an appropriate computer environment.

One technique for generating the correlated tap weights by a matrix weighting correlator 19 is to utilize a suitable computer and/or an array processor for correlator 19. A determination of the co-variance matrix to provide optimized tapweights is described mathematically in Appendix A which discusses the mean square error criterion used in determining the optimum tap weights and explains how such criterion can be used by those in the art to derive the desired tap weight co-variance matrix, as will be understood from such description by those in the art. The mathematical description is exemplary only and describes an example of a procedure therefor with respect to a single channel simulation. Other approaches to the formation of a matrix configuration for multiplying the random noise inputs to achieve correlated outputs will occur to those in the art for achieving desired correlated tap weights for a particular application using acceptable criteria therefor, in accordance with the invention.

An alternative exemplary technique for providing a desired matrix multiplication operation to obtain correlated weighting signals from uncorrelated noise signal inputs is shown in a digital implementation in FIG. 3. As can be seen, a plurality of noise signal inputs ($u_1$, $u_2$ . . . $u_n$) are supplied, e.g., sequentially, to a random access memory (RAM) 20 and stored therein as uncorrelated tap weights. A first matrix multiplication can be performed utilizing appropriate matrix values as stored in a first matrix RAM 21 such matrix being of the form:

$$\begin{matrix} T_{11} & 0 & 0 & 0 \\ 0 & T_{22} & 0 & 0 \\ 0 & 0 & T_{33} & 0 \\ 0 & 0 & 0 & T_{44} \end{matrix} \qquad (1)$$

In such matrix each component $T_{11}$, $T_{22}$, . . . etc. is itself a matrix of values which effect the correlation among delays on that corresponding diversity branch.

An appropriate matrix of the above form can be selected to provide correlation between the tap weight signals on any particular delay line in any particular diversity branch. Thus in a 4-diversity branch system the above matrix (1) provides correlation among the taps in each branch but does not provide any correlation between branches. Such matrix is supplied to multiplier 21 for use in multiplying each of the uncorrelated noise source tap weighting signals so as to produce correlated weighting signals which can be stored in an accumulator storage device 22 for providing such correlated weighting signals as the tap weights for each of the delay lines involved without providing any further correlations among them. Such correlated outputs can then be permanently stored in RAM 23, the output thereof being usable to provide correlated tap weights for each of the multipliers associated with the delay lines in each of the diversity branches as desired.

However, if, in addition thereto, it is desired to provide not only correlated tap weights within a particular diversity branch but also correlated weights between adjacent diversity branches a second matrix multiplication by a second matrix stored in a second matrix RAM 24 can be utilized for such purpose. Such matrix may be of the following form:

$$\begin{matrix} I & 0 & 0 & 0 \\ T_{12} & I & 0 & 0 \\ 0 & T_{23} & I & 0 \\ 0 & 0 & T_{34} & I \end{matrix} \qquad (2)$$

Such matrix can be used to multiply the correlated tap weights from RAM 23 at multiplier 25 for temporary storage in accumulator 26 and from there such correlated signals can be supplied to a RAM 27 for storage therein. The output of RAM 27 can then be used to provide tap weights which are correlated both within the delay lines of each of the diversity branches and also in a particular embodiment between adjacent diversity branches.

If it is desired further to provide for correlations among all of the tap weighting signals supplied to the delay lines in all of the diversity branches, a further matrix can be utilized as stored in a third matrix RAM 28, such matrix being used to multiply the correlated outputs from RAM 27 at multiplier 29 and, for example, being of the following form:

| | | | | |
|---|---|---|---|---|
| I | 0 | 0 | 0 | |
| 0 | I | 0 | 0 | (3) |
| $T_{13}$ | 0 | I | 0 | |
| $T_{14}$ | $T_{24}$ | 0 | I | |

Each of the entries T and I, as mentioned above with respect to Matrix (1), is itself a matrix.

The matrix multiplication for each of the tap weights from RAM 27 can be temporarily stored in accumulator 30 and then the completed matrix multiplication products stored in RAM 31. The output of RAM 31 can then be supplied to the tap multipliers in each of the diversity branches to provide correlated weighting signals in which correlation among weighting signals for all of the delay line taps among all of the diversity branches is provided. The implementation of FIG. 3 permits the channel simulator to be utilized for whatever stage of correlation is desired, from a condition in which no correlation is provided, i.e., the uncorrelated noise sources are used directly from RAM 20 (as in the prior art), or correlations only among tap weighting signals in each branch are provided from RAM 23 or correlations not only among taps but also between adjacent diversity branches are provided from RAM 27, or correlated tap weights for all taps among all diversity branches are provided from RAM 31.

The implementation shown in FIG. 3 may be better suited for relatively complicated channels with relatively high fade rates and delay lines using many taps. The particular matrix implementations of FIG. 3 are designed for a case in which four diversity branches are used and 16 taps are utilized on the delay lines of each diversity branch. The total number of complex weights therefor is 64, or 128 real tap weights (both In-phase and Quadrature components). While the matrix multiplications depicted are shown as achieved in essentially three stages as discussed above for each of the matrices (1), (2), and (3), shown above, it would be clear to those in the art that, if desired, the overall multiplication for achieving correlation among all taps and all diversity branches could be obtained by utilizing a single RAM for effectively performing such an overall matrix multiplication all at once.

The advantages of the invention can be appreciated by considering, first of all, the number of taps required for the correlated tap weight simulator of the invention as opposed to previously proposed simulator designs using uncorrelated tap weights. Appropriate analysis shows that the number of taps required, for example, for a single channel simulation for a particular bandwidth-delay spread product WL (where W is the bandwidth and L is the delay) and for a channel error $E_C$ of less than 0.05 as discussed in Appendix A, a comparison of the number of taps required for simulating in accordance with the invention and in accordance with conventional uncorrelated simulators can be made. It is shown that for a bandwidth-delay spread product of WL=1 that the simulator of the invention utilizes one-half the number of taps required for such conventional simulators, while for a bandwidth delay spread product of WL=3 or more, the number of taps required for the simulator of the invention is only about one-third the number of taps required for conventional simulators. Since the number of taps and, accordingly, the number of multipliers associated with them contribute greatly to the cost of the simulator, it is seen that a simulator of the invention is much more cost effective.

Moreover, in providing a simulator in accordance with the invention as shown in FIG. 1 or FIG. 2 wherein the matrix weighting correlation is performed through implementation on an array processor, e.g., an array processor made and sold under the designation FPS-100, made and sold by Floating Point Systems, Inc., of Oregon, the operation of which is controlled by a PDP-11/70 computer, for example, made and sold by Digital Equipment Corporation of Maynard, Mass., a comparison has been made of the error when using the correlated tap weight concept of the invention as opposed to uncorrelated tap weight concept as used in conventional simulators. The following cases were investigated, all having bandwidths of W=5 MHz, and tap spacings of $_0$=100 nsec, and a fade rate of 10 kHz. (In the investigation the fade rate is made relatively high in order to reduce the overall simulation time for comparison purposes.) In such case a 4-tap delay line was used for the single diversity branch system which was investigated. The following chart shows a comparison of the normalized frequency correlation function mean-squared error for each of the cases for different power impulse responses for the channel.

| Power Impulse Response $Q(\tau)$ | Normalized Frequency Correlation Function Error: Uncorrelated (Conventional Simulation) | 2-Taps Correlated | 4-Taps Correlated |
|---|---|---|---|
| $\delta(\tau - \frac{1}{2}\tau_0)$ | 0.330 | 0.0169 | 0.000618 |
| $\delta(\tau - 1.5\,\tau_0)$ | 0.329 | 0.0172 | 0.000264 |
| $\delta(\tau - 2.5\,\tau_0)$ | 0.329 | 0.0172 | 0.000584 |

The power impulse response, in effect, defines the channel multipath characteristics while the column labelled "2-Taps Correlated" represents the condition in which two adjacent taps of the 4-tap delay line had tap weights which were appropriately correlated, while the column labeled "4-Taps Correlated" represents a condition in which all of the taps of the delay line had tap weights which were appropriately correlated. As can be seen therein, even in the case of correlations only with respect to adjacent taps a significant improvement in the error is noted with respect to the error obtained for uncorrelated taps as in a conventional simulator, while using correlations among all of the taps further decreases the error by several orders of magnitude and provides an extremely effective improvement over previously used channel simulators.

While particular embodiments of the invention are discussed above, other techniques for obtaining correlated tap weights from uncorrelated sources will occur to those in the art within the spirit and scope of the invention. Thus, the filter means used in the system may be a filter means other than a delay line. Moreover, the order in which the signal splitting operation, the filtering operation, and the weighted signal multiplication operation is achieved may be varied as appropriate in any particular application. Hence the invention is not to be considered as limited to the particular embodiments disclosed and discussed above, except as defined by the appended claims.

APPENDIX A

MATHEMATICAL DESCRIPTION OF SINGLE CHANNEL SIMULATION

1. General

The troposcatter channel is characterized by uncorrelated scatterers at different delays. The scatterers are time varying and can be assumed stationary. Mathematically the input-output relationship is $$y(t) = \int_0^L d\tau\, h(\tau,t) \times (t-\tau)$$

where $h(\tau,t)$ is the time varying impulse response. It is assumed that the maximum channel delay L is known. $h(\tau,t)$ is a random complex Gaussian process with the autocorrelation function $$E[h(\tau_1,t_1)h'(\tau_2,t_2)] = Q(\tau_1,t_1-t_2)\delta(\tau_1-\tau_2).$$

$Q(\tau,O)$ is called the power impulse response. The input-output relationship can also be written in terms of the time varying transfer function H(f,t), $$H(f,t) = \int_0^L d\tau\, h(\tau,t)\exp(-j2\pi f\tau),$$

so that $$y(t) = \int_{-\infty}^{\infty} df\, H(f,t) \times (f)\exp(j2\pi ft).$$

Note: X(f) is bandlimited.

The simulation of the random channel consists conceptually of two stages:

(1) Generate the random functions $h(\tau,t)$ with the desired characteristics.

(2) For each sample impulse response $h(\tau,t)$ find N tap gains $h_n$ to best approximate the channel.

A typical criterion of goodness is that the simulated transfer function approximate the actual transfer function in a least mean square sense over the desired bandwidth. We then want to pick the tap gains $\{h_n\}$ to minimize $$\frac{1}{W} \int_{-w/2}^{w/2} df\, |H(f,t) - \hat{H}(f,t)|^2$$

where, with tap spacing $\tau_O$, $$\hat{H}(f,t) = \sum_{n=1}^{N} h_n(t)\exp(-j2\pi f_n\tau_0).$$

Note that a weighted LMS criterion or peak error could be used as well.

Why is this a good criterion? If $\hat{y}(t)$ is the output of the simulated channel then $$E\{|y(t)-\hat{y}(t)|^2\} = \int df\, \overline{|H(f,t)-\hat{H}(f,t)|^2}\, |X(f)|^2,$$

so the output of the simulator will closely approximate the output of the channel for any transmission in the desired bandwidth W. Since the transmitted spectrum is totally within the design bandwidth W we only need to minimize the error over that bandwidth.

We now make two simplifying assumptions:

(1) The Doppler spectrum is the same at all delays, i.e., $Q(\tau,t_1-t_2) = Q_0(\tau)b(t_1-t_2)$, when $b(O)=1$, and (2) Fading is slow and stationary so that we can neglect the fading in the evaluation of the simulation performance.

These assumptions are reasonable for most practical simulator applications. The concepts described here also apply to the case where the Doppler spectrum is not the same at all delays but the results are more complicated.

2. Optimum Tap Weights

The optimum tap weights, $h_i$, for the general weighted error criterion $$\epsilon_2^2 = \int_{-W/2}^{W/2} w(f)\, |H(f) - \hat{H}(f)|^2 df$$

are easily derived. $\epsilon_2^2$ can be written in the vector form $$\epsilon_2^2 = c_0 + \underline{h}'\underline{\Lambda}\underline{h} - \underline{h}'\underline{a} - \underline{a}'\underline{h}.$$

Here $\underline{h}$ is the column vector of tap gains $\{h_k\}$ and $\underline{h}'$ is its transposed conjugated row vector. The constant $C_0$, the vector $\underline{a}$, and the matrix $\Lambda$ are given by ($s_k$ is the location of the K' th tap):

$$c_0 = \int_{-W/2}^{W/2} w(f)\, |H(f)|^2 df$$

$$a_k = \int_{-W/2}^{W/2} w(f)\, H(f)\exp[j2\pi f s_k]\, df \quad k = 1,2,\ldots,N;$$

$$\Lambda_{kl} = \int_{-W/2}^{W/2} w(f)\exp[j2\pi f(s_k - s_l)]\, df, \quad k,l = 1,1,\ldots,N.$$

The optimal tap gains $\{h_k\}$ are then given by $$\underline{h} = \underline{\Lambda}^{-1}\underline{a},$$

and the corresponding squared error is $$\min_{\underline{h}} \epsilon_2^2 = c_0 - \underline{a}'\,\underline{\Lambda}^{-1}\,\underline{a}.$$

The operations involved in constructing the optimal gains are illustrated in FIG. 1. Note that when the taps are equally spaced, $s_k = k\tau_0 + s_0$, then $\Lambda$ is a Toeplitz matrix, which greatly simplifies the matrix inversion.

Note that h can be written in the form $$\underline{h} = \int d\tau\, h(\tau)\underline{g}(\tau),$$

where the vector $\underline{g}(\tau)$ is the solution to the vector equation $$[\Lambda\, g(\tau)]_k = \int_{-W/2}^{W/2} df\, W(f)\exp(j2\pi f(\tau - s_k))^2.$$

We now summarize the statistical results for the special case of uniform weighting in the frequency domain.

3. Tap Weight Statistics for $w(f) = 1/W$ $$h\,h' = \Lambda^{-1}\,a\,a'\,\Lambda^{-1}$$

$$a_k = \frac{1}{W}\int_{-W/2}^{W/2} H(f)\exp(j2\pi f s_k)df$$

$$= \int_0^L d\tau\, h(\tau)\,\mathrm{sinc}W(\tau - s_k)$$

$$a_k a_l = \int_0^L d\tau\, Q(\tau)\,\mathrm{sinc}W(\tau - s_k)\,\mathrm{sinc}W(\tau - s_l).$$

Hence the tap weight covariance matrix is $$\phi = h\,h' = \int_0^L d\tau\, Q(\tau)\, g(\tau)\, g'(\tau)$$

The mean squared error is found to be given by $$\epsilon_2^2 = \int_0^L d\tau\, Q(\tau)\left[1 - \sum_k \mathrm{sinc}[W(\tau - s_k)]\, g_k^*(\tau)\right].$$

The worst case bound is $$\epsilon_2^2 < E_0^2 \int d\tau Q(\tau)$$

where $$E_0^2 = \max_\tau 1 - \sum_k \mathrm{sinc}[w(\tau - s_k)]\, g_k^*(\tau).$$

Equality is achieved when $Q(\tau)=\phi(\tau-\tau_{max})$ where $\tau_{max}$ is a value of $\tau$ achieving equality in the expression for $E_0^2$. The covariance matrix $\Phi$ is *not* diagonal in general. Hence the smallest error is achieved when the tap covariance matrix is allowed to be a general covariance matrix, i.e., with correlated taps.

4. Frequency Correlation Function, Simulation Accuracy

Frequency Correlation Function of the Channel $$\hat{R}(f_1, f_2) = E\{H(f_1)\, H^*(f_2)\}$$

$$= \int_0^L d\tau\, Q(\tau)\exp[j2\pi\tau(f_2 - f_1)]$$

Frequency Correlation Function of the Simulator $$R(f_1, f_2) = E\left\{\sum_n \sum_m h_n\, h_m^* \exp[j2\pi f_2 s_m - j2\pi f_2 s_n]\right\}$$

$$= \int_0^L d\tau Q(\tau) \sum_n \sum_m g_n(\tau) g_m^*(\tau) \exp[j2\pi f_2 s_m - j2\pi f_1 s_n]$$

Error

For any error norm we have $$||R - \hat{R}|| < \int_0^L d\tau\, Q(\tau)\left|\left|\exp[j2\pi\tau(f_2 - f_1)] - \sum_n \sum_m g_n(\tau)\, g_m(\tau)\exp[j2\pi(f_2 s_m - f_1 s_n)]\right|\right|$$

-continued $$\triangleq \int_0^L d\tau\, Q(\tau)\,||\,\Delta(f_1, f_2;\tau)|| < \max_{0<\tau<L} ||\,\Delta(f_1 f_2;\tau)||\int_0^L d\tau\, Q(\tau)$$

Equality is again achieved for $Q(\tau)=\delta(\tau-\tau_{max})$, proving that the most difficult channel to simulate is a delta function. For a mean square norm, $$E_c^2 \equiv ||R - \hat{R}||^2 = \frac{1}{W^2}\int df_1 \int df_2\, |\,R(f_1, f_2) - \hat{R}(f_1, f_2)|^2,$$

we find that when the power impulse response $Q(\tau)$ is a delta function $$E_c^2 = 2E_0^2 - E_0^4$$

where $E_0^2$ is the mean squared error in representing the transfer function.

What is claimed is:

1. A channel propagation simulator for simulating the operation of a signal channel having one or more diversity branches, said channel simulator comprising means for supplying an input signal;

means for generating a plurality of weighting signals, said weighting signals being selectively correlated with each other;

signal weighting means responsive to said input signal and to said plurality of weighting signals for providing a plurality of weighted output signals associated with each of said one or more diversity branches; and means for combining the weighted output signals associated with each of said one or more diversity branches to provide one or more combined output signals representing the simulated outputs from each of said one or more diversity branches.

2. A channel propagation simulator in accordance with claim 1 wherein said signal weighting means comprises filter means; and weighting means;

said filter means and said weighting means being responsive to said input signal and to said plurality of weighting signals for providing said plurality of weighted output signals associated with each of said one or more diversity branches.

3. A channel propagation simulator in accordance with claim 2 wherein said filter means comprises at least one time delay means.

4. A channel propagation simulator for simulating the operation of a signal channel having one or more diversity branches, said channel simulator comprising time delay means;

means for supplying an input signal to said time delay means, said time delay means providing for each of said one or more diversity branches a signal representing the input signal with no time delay and one or more further signals each representing the input signal delayed by selected time delays;

means for generating a plurality of weighting signals, said weighting signals being selectively correlated with each other;

means associated with each of said one or more diversity branches for multiplying the undelayed input signal and said one or more time delayed input signals by selected ones of said selectively correlated weighting signals to provide a plurality of weighted output signals associated with each of said one or more diversity branches; and means for combining the weighted output signals from the multiplying means associated with each of said one or more diversity branches to provide one or more combined output signals representing the simulated outputs from each of said one or more diversity branches.

5. A channel propagation simulator in accordance with claim 4 wherein said time delay means comprises one or more delay lines each associated with one of said one or more diversity branches for supplying said signals representing said undelayed input signal and said one or more further delayed signals.

6. A channel propagation simulator in accordance with claim 5 and further including signal splitting means responsive to said input signal for providing said input signal to each of said one or more delay lines.

7. A channel propagation simulator in accordance with claim 4 wherein said time delay means comprises a single delay line responsive to said input signal for supplying said signal representing said undelayed input signal and said one or more further delayed signals.

8. A channel propagation simulator in accordance with claim 7 and further including a plurality of signal splitting means responsive to the undelayed input signal and to the further signals provided by said delay line for supplying said undelayed input signal and said further signals for each of said one or more diversity branches.

9. A channel propagation simulator in accordance with claim 4 wherein said weighting signals generating means generates weighting signals such that the weighting signals supplied to the multiplying means associated with each diversity branch are at least partially correlated with each other.

10. A channel propagation simulator in accordance with claim 9 wherein the weighting signals supplied to each diversity branch are partially correlated in a manner such that adjacent weighting signals are correlated with each other.

11. A channel propagation simulator in accordance with claim 9 wherein the weighting signals supplied to each diversity branch are all correlated with each other.

12. A channel propagation simulator in accordance with claim 4 wherein said weighting signals generating means generates weighting signals such that the weighting signals supplied to the multiplying means of different diversity branches are at least partially correlated with each other.

13. A channel propagation simulator in accordance with claim 12 wherein the weighting signals supplied to adjacent diversity branches are correlated with each other.

14. A channel propagation simulator in accordance with claim 12 wherein the weighting signals supplied to all diversity branches are correlated with each other.

* * * * *